US007261159B2

(12) United States Patent
Kneisl

(10) Patent No.: US 7,261,159 B2
(45) Date of Patent: Aug. 28, 2007

(54) PERFORATING METHOD

(75) Inventor: Philip Kneisl, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 233 days.

(21) Appl. No.: 11/160,223

(22) Filed: Jun. 14, 2005

(65) Prior Publication Data

US 2006/0278392 A1 Dec. 14, 2006

(51) Int. Cl.
*E21B 43/11* (2006.01)
*E21B 43/22* (2006.01)

(52) U.S. Cl. ..... 166/297; 166/402; 166/403

(58) Field of Classification Search ..... 166/297, 166/305.1, 270.1, 402, 403
See application file for complete search history.

(56) References Cited

U.S. PATENT DOCUMENTS 3,368,627 A * 2/1968 Hurst et al. ..... 166/307
3,765,488 A * 10/1973 Pence, Jr. ..... 166/308.6
4,480,696 A * 11/1984 Almond et al. ..... 166/308.6
4,615,389 A * 10/1986 Neely et al. ..... 166/250.01
RE32,302 E * 12/1986 Almond et al. ..... 166/308.6
4,856,589 A 8/1989 Kuhlman et al. ..... 166/273
4,860,828 A 8/1989 Oswald et al. ..... 166/274
4,887,671 A 12/1989 Stevens, Jr. ..... 166/308
4,913,235 A 4/1990 Harris et al. ..... 166/273
5,358,046 A * 10/1994 Sydansk et al. ..... 166/275
5,363,915 A 11/1994 Marquis et al. ..... 166/274
5,711,373 A 1/1998 Lange ..... 166/252.2
6,662,874 B2 12/2003 Surjaatmadja et al. ..... 166/308
7,182,138 B2 * 2/2007 Behrmann et al. ..... 166/311
2004/0099418 A1 * 5/2004 Behrmann et al. ..... 166/312

* cited by examiner

*Primary Examiner*—Jennifer H Gay
(74) *Attorney, Agent, or Firm*—Williams, Morgan & Amerson; Kevin B. McGoff; Bryan P. Galloway

(57) ABSTRACT

A method for perforating a wellbore comprises placing a perforating device in a cased wellbore that passes through a subterranean formation. The perforating device comprises at least one explosive perforating charge that can be detonated in order to perforate the casing and allow the formation fluids to enter the wellbore. A perforating fluid is placed in the wellbore between the perforating device and the casing. The ratio of the critical temperature of the perforating fluid in ° K and the temperature of the subterranean formation adjacent to the casing in ° K is between about 1.0-1.3. When the at least one explosive charge in the perforating device is detonated, at least one perforation is formed in the casing, and at least a portion of the perforating fluid is forced into the subterranean formation.

13 Claims, 2 Drawing Sheets

PERFORATING METHOD

BACKGROUND OF THE INVENTION

The present invention relates generally to a method of perforating the casing in a well from which oil and/or gas can be produced.

In order to produce hydrocarbon fluids from subterranean formations, a borehole is drilled from the surface down into the desired formations. Typically, cylindrical casing is placed in the borehole, thereby defining a hollow wellbore. In order for the hydrocarbon fluids to flow from the surrounding formations into the wellbore and up to the surface, it is necessary to perforate the casing. This is typically done using a perforating gun, a downhole tool that detonates explosive charges at selected locations in order to form holes in the casing.

Because the fluids in the formation are under pressure, a choice must be made whether to perforate the well with the bottom-hole pressure in the wellbore lower or higher than the formation pressure. The former condition is referred to as "underbalanced" and the latter condition is referred to as "overbalanced".

It has been common in recent years to perforate the casing of a well in an underbalanced condition. For high pressure reservoirs, an underbalanced condition is easy to achieve. However, if the pressure in the formation is relatively low, it may be difficult or impossible to achieve a lower pressure in the wellbore, especially considering the great depth of some wells. In that situation, the well operator does the best that is possible under the circumstances, and perforates the well with whatever liquid is in the wellbore.

Experience has shown that different wellbore fluids can have significant effects on production rates. For example, perforating with brine in the wellbore usually results in two-phase (oil and water) flow in the formation pores. This condition is known to deleteriously affect production rates. It is also possible to perforate with an oil-based mud in the wellbore. This eliminates the two-phase flow in the formation pores, but can results in plugging some pores with the solid (clay) portion of the mud.

There is a need for improved methods of perforating well casing that reduce or eliminate at least some of the above-described problems.

SUMMARY OF THE INVENTION

One embodiment of the invention is a method for perforating a well. The well has a wellbore that is defined by a generally cylindrical casing in at least part of the wellbore (i.e., the wellbore is cased, although it is not necessary cased in its entire length). The wellbore passes through a subterranean formation that comprises hydrocarbon formation fluids (such as oil and/or gas), at least in certain strata. The method comprises placing a perforating device in a wellbore. The perforating device comprises at least one explosive perforating charge that can be detonated in order to perforate the casing and allow the formation fluids to enter the wellbore. The casing is thus located between the subterranean formation and the perforating device.

A perforating fluid is placed in the wellbore between the perforating device and the casing, at least for a portion of the wellbore. In other words, the perforating fluid is present in the wellbore adjacent to the perforating device, but the same fluid does not have to be present in the entire length of the wellbore. The ratio of the critical temperature of the perforating fluid in ° K and the temperature of the subterranean formation adjacent to the casing in ° K is between about 1.0-1.3.

The at least one explosive charge in the perforating device is detonated, such that the perforating device forms at least one perforation in the casing that permits the flow of hydrocarbon formation fluids from the subterranean formation into the wellbore. As a result of the detonation, at least a portion of the perforating fluid is forced into the subterranean formation.

In another embodiment of the invention, a perforating device (as described above) is placed in a cased wellbore in a subterranean formation. A perforating fluid that comprises at least about 50 wt % carbon dioxide is placed in the wellbore between the perforating device and the casing. The at least one explosive charge is detonated, whereby at least one perforation is formed in the casing, and at least a portion of the perforating fluid is forced into the subterranean formation.

DESCRIPTION OF ILLUSTRATIVE EMBODIMENTS

Figure 1:
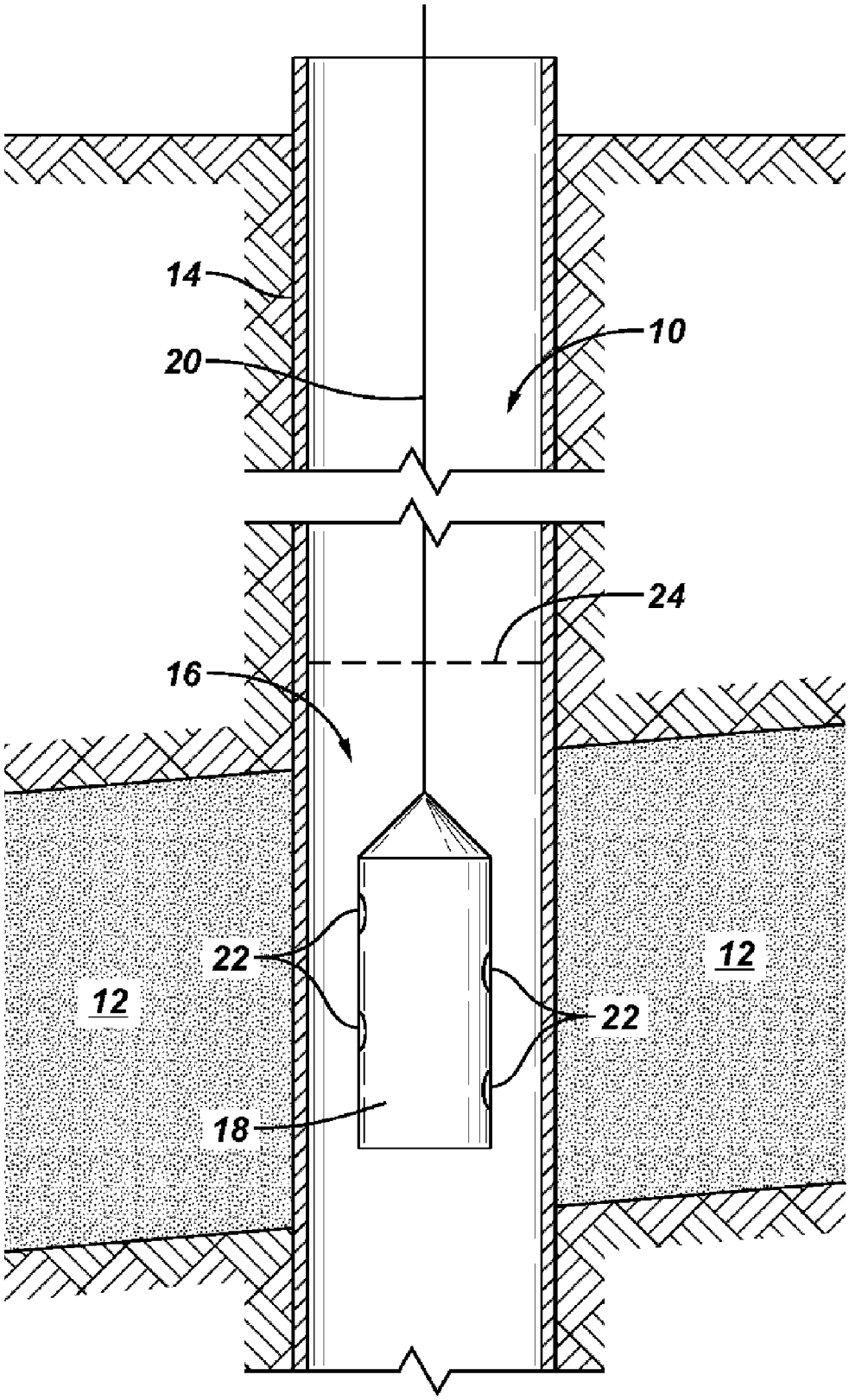
FIG. 1 is a schematic diagram of a perforating system of the present invention, prior to detonation of the perforating charges.

In one embodiment, the present invention relates to a method of perforating a well casing that involves using a perforating fluid. The composition of the perforating fluid can minimize damage to the formation that has been caused by some fluids that have been used in the past, and can even enhance production of oil and gas from the formation.

In one embodiment of the invention, the ratio of the critical temperature of the perforating fluid in ° K and the temperature of the subterranean formation adjacent to the casing in ° K is between about 1.0-1.3. Therefore, given the temperature of the formation at the depth of interest, one can select a perforating fluid composition whose critical temperature will yield the desired ratio. Fluids in this range tend to have good dissolving power like liquids, excellent miscibility, low viscosity, and high diffusion rates like gases.

For example, the perforating fluid can comprise a supercritical fluid, such as supercritical carbon dioxide. The fluid can optionally contain additional components, such as one or more alcohols and/or surfactants. Alternatively, the perforating fluid can consist essentially of supercritical carbon dioxide, with only very small amounts (if any) of other materials present.

Carbon dioxide has a critical temperature of 304° K and a critical pressure of 1072 psia. Supercritical carbon dioxide is mutually soluble in both oil and water. It also lowers the surface tension at the liquid-solid interface in the reservoir, and simultaneously lowers the reservoir fluid viscosity. These changes in properties enhance wetting of the pores in the reservoir and increase fluid flow rates (e.g., production rates). These desirable effects are especially evident with supercritical carbon dioxide at temperatures in the range of 304° K to 395° K. An additional benefit of supercritical carbon dioxide is that its compressibility will effectively reduce shock and detonation pressures in the wellbore during perforation.

Although the perforating fluid can contain supercritical carbon dioxide, it does not necessarily have to include that material. In wells having a temperature greater than about 395° K, the desirable properties of supercritical carbon dioxide are diminished. However, the properties of the perforating fluid can be enhanced by blending other compounds, such as surfactants and/or alcohols, with carbon dioxide. It is also possible for the perforating fluid to comprise primarily plain water or brine, with one or more surfactants or alcohols added to modify the properties of the fluid. As mentioned above, the fluid composition is chosen so that the ratio of the critical temperature of the perforating fluid in ° K and the temperature of the subterranean formation adjacent to the casing in ° K is between about 1.0-1.3.

Numerous surfactants are suitable for use in the perforating fluid. Suitable examples include sodium dodecyl orthoxylene sulfonate, sodium 4-phenyl-dodecyl sulfonate, and combinations thereof. One commercially available surfactant that can be used is TRS-80 surfactant from Witco.

Likewise, numerous alcohols can be used, for example one or more aliphatic alcohols having from 2-10 carbon atoms. Suitable examples include n-propanol, isopropanol, n-butanol, n-heptanol, and combinations of two or more thereof.

In general, any component known to be useful for miscible oil field flooding can be used in a perforating fluid of the present invention.

In one specific embodiment of the invention, the perforating fluid comprises at least about 50 wt % carbon dioxide. In other embodiments, the carbon dioxide content of the fluid can be at least about 75 wt %, at least about 90 wt %, or at least about 99 wt %.

FIG. 1 shows a schematic of a perforating system in which the above-described perforating fluid can be used. A borehole 10 has been drilled from the surface down through subterranean formations 12 that contain hydrocarbon formation fluids, namely oil and/or gas. A generally cylindrical casing 14 lines the wall of the borehole, defining the wellbore 16. A perforating gun 18 has been lowered into the well on a wireline 20. The perforating gun includes at least one, and usually several explosive perforating charges 22. These charges are oriented such that when they are detonated, the force of the explosion will be primarily directed outward toward the casing (i.e., horizontally outward in FIG. 1). Detonation is triggered by a signal delivered through a control line from the surface (not shown in the figures).

The perforating fluid is located in the wellbore adjacent to the perforating gun 18. As depicted in FIG. 1, the wellbore has been filled with the perforating fluid to a depth sufficient to cover the perforating device (i.e., up to the level indicated by the dotted line 24). Thus, the perforating fluid is located between the perforating device and the casing, or more precisely, between the explosive perforating charges and the casing. There are a variety of ways that the perforating fluid can be placed in this position. For example, packers or other flow control devices could be used to define an enclosed space in the wellbore adjacent to the perforating gun, and then that defined space could be completely or partially filled with the perforating fluid.

Figure 2:
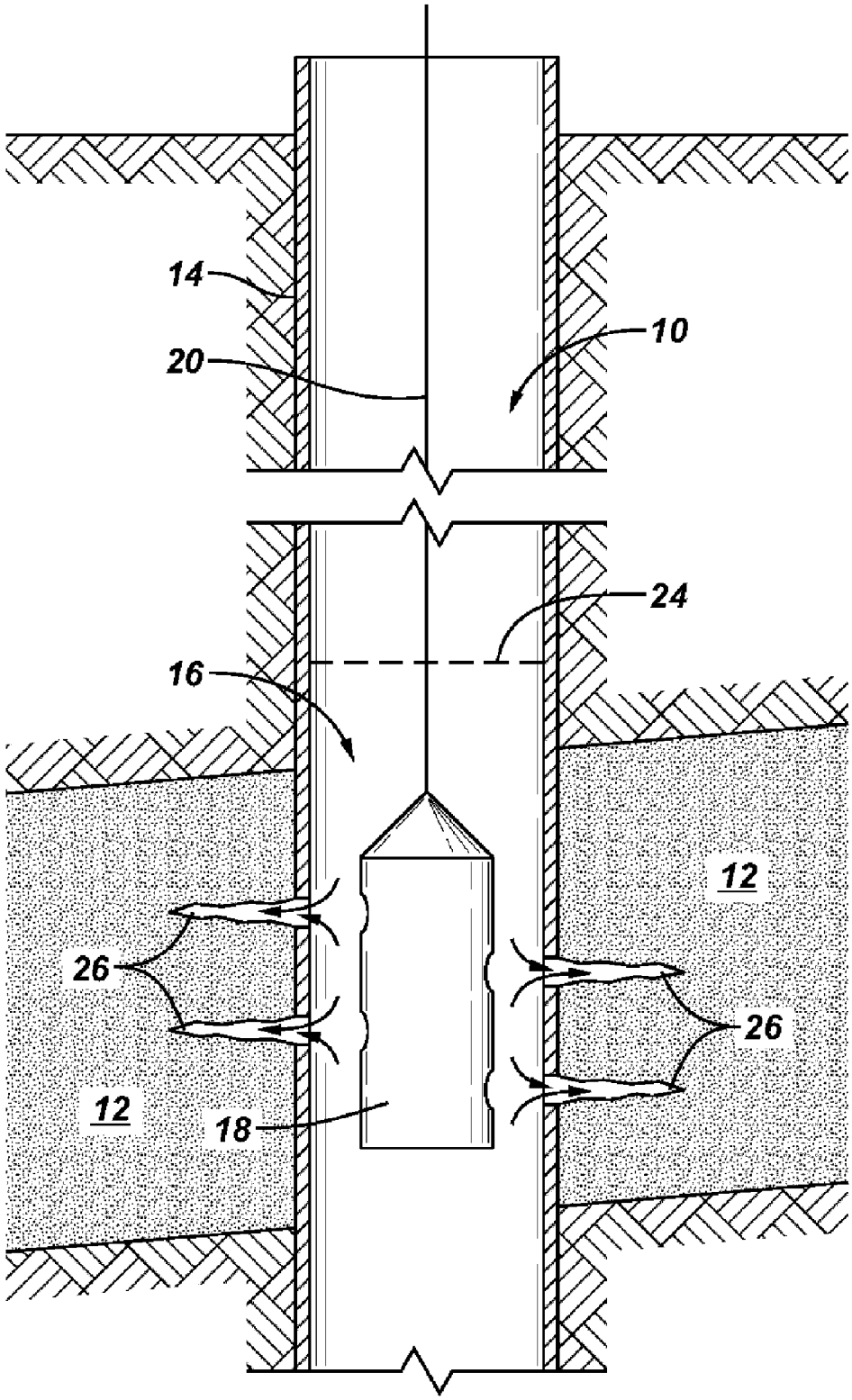
FIG. 2 is a schematic diagram of a perforating system of the present invention, after detonation of the perforating charges.

When the explosive perforating charges are detonated, perforations 26 are formed in the casing, as shown in FIG. 2. The force of the explosion also causes at least some of the adjacent perforating fluid to be forced out into the formation, as indicated by the arrows in FIG. 2.

It will usually be easier to place the perforating fluid in the wellbore between the perforating device and the casing prior to detonation. However, it would also be possible to provide the fluid at approximately the same time as the detonation.

The use of the above-described method will improve formation wetting by both oil and water reservoir fluids. This helps prevent irreversible two-phase flow damage to the reservoir and helps increase production of reservoir fluids. This method is especially beneficial when the wellbore conditions are such that perforation cannot be accomplished in an underbalanced condition, and instead must be performed in the balanced or overbalanced condition.

The preceding description is not intended to be an exhaustive list of every possible embodiment of the present invention. Persons skilled in the art will recognize that modifications could be made to the embodiments described above which would remain within the scope of the following claims.

What is claimed is:

1. A method for perforating a well, comprising:

placing a perforating device in a wellbore, wherein the wellbore is defined by a generally cylindrical casing and passes through a subterranean formation that comprises hydrocarbon formation fluids, wherein the perforating device comprises at least one explosive perforating charge that can be detonated, and wherein the casing is located between the subterranean formation and the perforating device;

placing a perforating fluid in the wellbore between the perforating device and the casing, wherein the ratio of the critical temperature of the perforating fluid in ° K and the temperature of the subterranean formation adjacent to the casing in ° K is between about 1.0-1.3; and detonating the at least one explosive charge, whereby the perforating device forms at least one perforation in the casing that permits the flow of hydrocarbon formation fluids from the subterranean formation into the wellbore, and at least a portion of the perforating fluid is forced into the subterranean formation.

2. The method of claim 1, wherein the step of placing a perforating fluid in the wellbore between the perforating device and the casing comprises filling the wellbore with the perforating fluid to a depth sufficient to cover the perforating device.

3. The method of claim 1, wherein the perforating fluid comprises a supercritical fluid.

4. The method of claim 3, wherein the perforating fluid comprises supercritical carbon dioxide.

5. The method of claim 4, wherein the perforating fluid consists essentially of supercritical carbon dioxide.

6. The method of claim 1, wherein the perforating fluid comprises at least one surfactant.

7. The method of claim 6, wherein the surfactant is sodium dodecyl orthoxylene sulfonate, sodium 4-phenyl-dodecyl sulfonate, or a combination thereof.

8. The method of claim 1, wherein the perforating fluid comprises at least one alcohol.

9. The method of claim 8, wherein the alcohol is n-propanol, isopropanol, n-butanol, n-heptanol, or a combination of two or more thereof.

10. The method of claim 1, wherein the perforating fluid comprises at least one surfactant or alcohol, and at least one of carbon dioxide, water, or brine.

11. The method of claim 1, wherein the perforating fluid is placed in the wellbore between the perforating device and the casing prior to the detonation.

12. The method of claim 1, wherein the perforating fluid is placed in the wellbore between the perforating device and the casing at approximately the same time as the detonation.

13. A method for perforating a well, comprising:

placing a perforating device in a wellbore, wherein the wellbore is defined by a generally cylindrical casing and passes through a subterranean formation that comprises hydrocarbon formation fluids, wherein the perforating device comprises at least one explosive perforating charge that can be detonated, and wherein the casing is located between the subterranean formation and the perforating device;

placing a perforating fluid that comprises at least about 50 wt % supercritical carbon dioxide in the wellbore between the perforating device and the casing; and detonating the at least one explosive charge, whereby the perforating device forms at least one perforation in the casing that permits the flow of hydrocarbon formation fluids from the subterranean formation into the wellbore, and at least a portion of the perforating fluid is forced into the subterranean formation.

* * * * *